US007395787B1

(12) United States Patent
Claypole et al.

(10) Patent No.: US 7,395,787 B1
(45) Date of Patent: Jul. 8, 2008

(54) AIR SEPARATOR FOR LOW FLOW RATE COOLING SYSTEMS

(75) Inventors: George M. Claypole, Fenton, MI (US); Mark D. Nemesh, Troy, MI (US); Lawrence P. Ziehr, Clarkston, MI (US); Paul S. Lombardo, Shelby Township, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/674,190

(22) Filed: Feb. 13, 2007

(51) Int. Cl.
*F01P 9/00* (2006.01)

(52) U.S. Cl. ..... 123/41.01; 123/41.31; 123/142.5 E; 237/12.3 B; 180/65.2; 165/41

(58) Field of Classification Search ..... 123/41.01, 123/41.31, 41.14, 41.55, 41.54, 142.5 E, 123/142.5 R; 237/12.3 B, 44, 75; 165/41, 165/51, 104.32; 180/65.2
See application file for complete search history.

(56) References Cited

U.S. PATENT DOCUMENTS 4,911,110 A * 3/1990 Isoda et al. ..... 123/41.14
5,553,662 A * 9/1996 Longardner et al. ..... 165/202
5,884,588 A * 3/1999 Ap et al. ..... 123/41.14
6,564,757 B2 * 5/2003 Suzuki et al. ..... 123/41.14
6,616,059 B2 * 9/2003 Sabhapathy et al. ..... 237/12.3 B
6,866,092 B1 * 3/2005 Molivadas ..... 165/104.21
7,040,303 B2 * 5/2006 Uzkan et al. ..... 123/563
7,128,025 B1 * 10/2006 Westhoff et al. ..... 123/41.01
7,140,330 B2 * 11/2006 Rogers et al. ..... 123/41.14
7,147,038 B2 * 12/2006 Taguchi ..... 165/41

OTHER PUBLICATIONS

Lexus 400h Service Manual, Section on Cooling System for Inverter, MG1 and MG2, of Toyota Motor Corporation, Toyota City, Japan, 3 pages (2006—similar to Toyota Prius 2004).

* cited by examiner

*Primary Examiner*—Stephen K. Cronin
*Assistant Examiner*—Hyder Ali

(57) ABSTRACT

An air separator for low flow rate coolant systems which removes air from the liquid coolant thereof. The air separator is a closed canister having a bottom wall, a top wall at a gravitationally high location with respect to the bottom wall, and a sidewall sealingly therebetween. A coolant inlet is at the sidewall, a pump outlet is at the bottom wall and a coolant reservoir outlet is at the top wall. The coolant reservoir outlet is connected to a coolant reservoir gravitationally elevated with respect to the canister. A much larger cross-sectional area per unit length of the canister relative to the piping results in a coolant dwell time in the canister that encourages coolant air bubbles to migrate toward the coolant reservoir.

16 Claims, 3 Drawing Sheets

AIR SEPARATOR FOR LOW FLOW RATE COOLING SYSTEMS

TECHNICAL FIELD

The present invention relates to low flow rate cooling systems of the type used in the motor vehicle art to cool electronics, as for example those associated with hybrid and fuel cell motor vehicles. Still more particularly, the present invention relates to an air separator of the low flow rate cooling system for removing air bubbles from the coolant liquid thereof.

BACKGROUND OF THE INVENTION

As for example shown at FIG. 1, a low flow rate cooling system 10 includes coolant piping 12 whereby a liquid coolant flows through a main heat exchanger 14 whereat heat of the coolant is exchanged with the atmosphere, and whereby heat is absorbed from various electronic devices 16*a*, 16*b* which may be connected in series, parallel or series-parallel with respect to each other. The coolant flows through a coolant reservoir (or surge tank) 18 having a removable cap 20 whereat filling is performed and air can escape. A pump 22 powered by an electric motor 24 (in combination, simply an electric pump 26) is connected by the coolant piping, the inlet of the pump being connected to the coolant reservoir, and the outlet of the pump being connected to the heat exchanger. The low flow rate cooling system 10 operates independently of the internal combustion engine coolant system 30, the transmission coolant system 40, and the air conditioning system 50. By "low flow rate" is meant that the coolant flows through the piping at a rate much slower than that utilized for internal combustion engine coolant system 30, as for example on the order of about five to twenty liters per minute (5 lpm to 20 lpm).

Motor vehicle applications of low flow rate cooling systems include hybrid motor vehicles and fuel cell motor vehicles. Hybrid motor vehicles utilize electrical components which supplement the internal combustion engine, as for example a power inverter and/or an electric drive motor, and other electrical components. Problematically, these electrical components generate heat which must be dissipated in order to operate within predetermined parameters. As such, a low flow rate coolant system is used to provide the heat dissipation, as needed. Fuel cell motor vehicles may also utilize a low flow rate cooling system for its electronic components, ie., cooling of power inverters, electric drive motors, etc. Also, a low flow rate coolant system may be used with air-to-coolant charge air coolers, as for example either turbo-charged or supercharged powertrains.

While low flow rate coolant systems perform well, there are a number of operational issues that need careful attention. A first issue relates to separation and removal of air bubbles from the coolant after a service fill, which is difficult because of the low coolant flow velocities. Air bubbles removal may require complex steps using vent valves in the system, may take a long time to accomplish, that is, require several system cycles, or may not be possible in some cases. Another issue relates to the fact that low flow rate cooling systems only use electric coolant pumps, wherein the coolant pressure drop at each component must be minimized to keep the size and power consumption of the electric coolant pump as small as possible. Also, the suction side system pressure differential, prior to the electric pump inlet fitting, is critical in achieving maximum pump pressure rise capacity. Yet another issue is that as the motor vehicle is driven, the vehicle motion in the vertical, fore-aft, and side-to-side directions can create churning of the coolant contained within the coolant reservoir of the system. This coolant churning in a flow-through coolant reservoir of a low flow rate cooling system can result in the creation of air bubbles which introduces air into the coolant. Yet another issue of low flow rate cooling systems is that air bubbles in the coolant create a thermal barrier to heat transfer between the electronic component and the coolant and between the coolant and the heat rejecting heat exchanger. Another issue is that multi-path low flow rate cooling systems require a central return path. Yet another issue is that low flow rate coolant pumps can easily loose prime with the introduction of small amounts of air which can render the cooling system inoperative causing thermal stress or failures of the components that are to be cooled by the system.

What remains needed in the art is an air separator for low flow rate coolant systems which facilitates operation of the coolant system and effectively removes air bubbles, while successfully addressing each one of the aforementioned issues.

SUMMARY OF THE INVENTION

The present invention is an air separator for low flow rate coolant systems which facilitates operation of the coolant system and effectively removes air bubbles from the liquid coolant thereof, while addressing the major issues associated with such systems.

The air separator according to the present invention is a closed canister having a bottom wall, a top wall at a gravitationally higher location with respect to the bottom wall, and a sidewall therebetween and sealingly connected thereto, wherein the sidewall may be preferably configured as a cylinder. At least one coolant inlet is provided at the sidewall preferably adjacent the top wall, a pump outlet is provided at the bottom wall and a coolant reservoir outlet is provided at the top wall. Each coolant inlet is connected to coolant piping at the return leg thereof, wherein the coolant is returning from a component (i.e., electrical component) being cooled by the coolant. The coolant reservoir outlet is connected to a coolant reservoir pipe connected to the coolant reservoir of the low flow rate coolant system, wherein the coolant reservoir is gravitationally elevated with respect to the canister. The pump outlet is connected to return coolant piping that is, in turn, connected to the inlet of a coolant pump of the low flow rate coolant system.

In operation, coolant flows into the canister from the one or more coolant inlets, wherein the cross-sectional area per unit length of the canister is much larger in relation to the average cross-sectional area per unit length of the coolant piping, as for example at least an order of magnitude larger cross-section, so that coolant has an extended dwell time in the canister before passing out through the pump outlet. This dwell time is sufficient to allow air bubbles to migrate upwardly to the top wall, whereupon the air bubbles exit the canister through the coolant reservoir pipe. At the coolant reservoir the air is removed from the system conventionally to the atmosphere out through the fill cap thereof.

The air separator according to the present invention addresses each of the issues of concern for low flow rate coolant systems, as follows.

The air separator provides both time and space for air separation from the coolant to occur. Proper integration of the air separator with the coolant path of the low flow rate cooling circuit eliminates the need for additional system hardware, such as for example vent valves, and simplifies the service fill procedure.

The air separator utilizes low pressure drop fittings which, when integrated into the low flow rate cooling system, provide a boost in electric coolant pump pressure rise capacity by providing a vertical coolant head on the inlet side of the pump.

The air separator is located vertically remote from the coolant reservoir to thereby provide a vertical fluid separation between the churning coolant inside the coolant reservoir, thereabove, and the coolant inside the air separator which is being drawn into the electric coolant pump inlet.

Flowbench development has shown that an air separator is highly effective in removing air bubbles from the coolant circuit, thereby maximizing heat transfer within the system.

In a multi-path low flow rate cooling system, the air separator provides a central return junction for each of the coolant loops, whereby the air separator functions as a central return point, and also serves as an effective distribution point for filling of the multiple coolant loops prior to operating the electric coolant pump(s).

Accordingly, it is an object of the present invention to provide an air separator for low flow rate coolant systems which facilitates operation of the coolant system and effectively removes air bubbles from the coolant, while addressing the major issues associated with such systems.

This and additional objects, features and advantages of the present invention will become clearer from the following specification of a preferred embodiment.

DESCRIPTION OF THE PREFERRED EMBODIMENT

Figure 1:
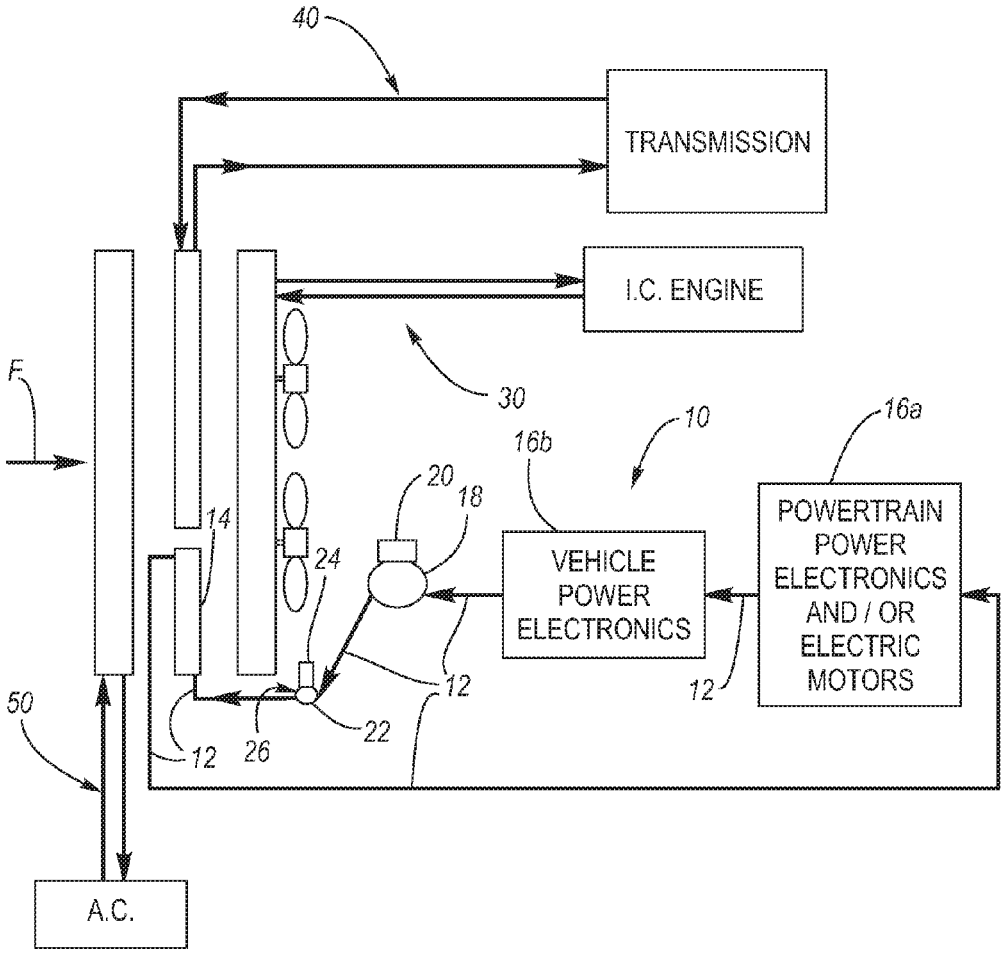
Prior Art Fig. 1
FIG. 1 is a schematic diagram of a conventional, prior art low flow rate coolant system, also depicting transmission, air conditioning, and internal combustion engine coolant systems of a motor vehicle.
Figure 2:
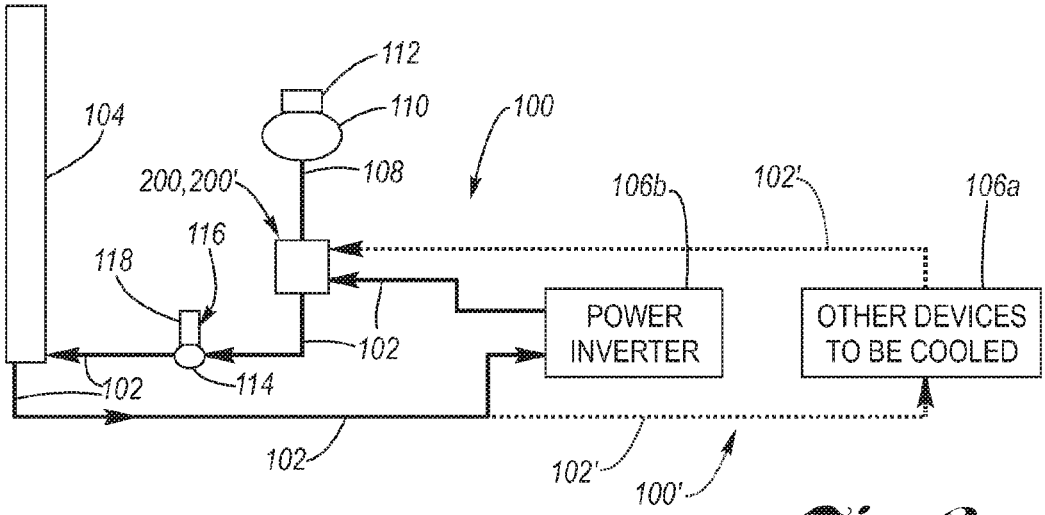
FIG. 2 is a schematic diagram of a low flow rate coolant system including the air separator according to the present invention.
Figure 3A:
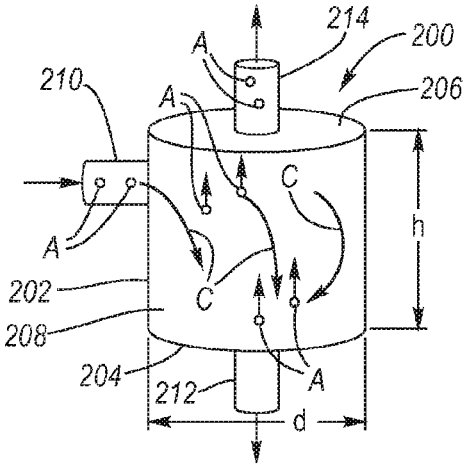
FIG. 3A is a perspective view of a first preferred embodiment of the air separator according to the present invention.
Figure 3B:
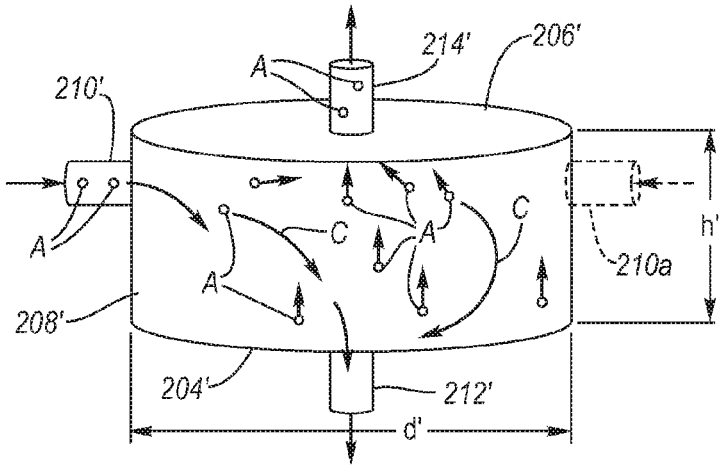
FIG. 3B is a perspective view of a second preferred embodiment of the air separator according to the present invention.
Figure 4:
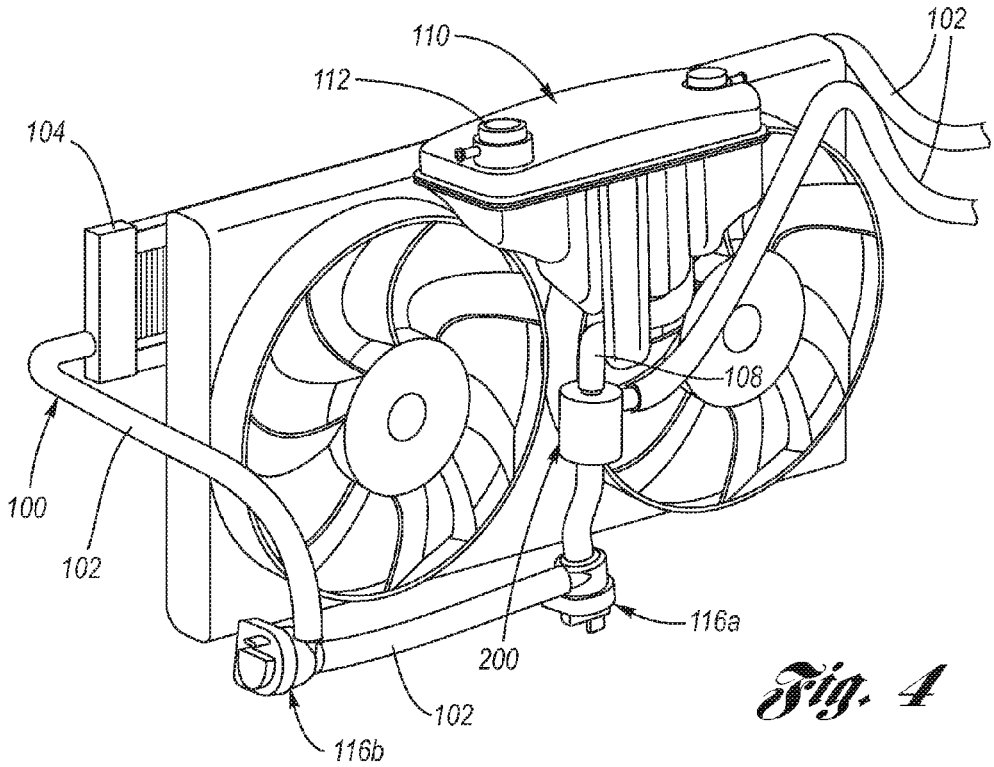
FIG. 4 is a perspective view of a portion of a low flow rate coolant system including the air separator according to the present invention.

Referring now to the Drawing, FIGS. 2 through 4 depict various structural and functional aspects of a low flow rate coolant system, suitable for a motor vehicle, which incorporates an air separator according to the present invention.

Turning attention firstly to FIG. 2, a low flow rate cooling system 100 includes coolant piping 102, 102' by which a liquid coolant C (see FIGS. 3A and 3B) flows through a main heat exchanger 104, whereat heat of the coolant is exchanged with the atmosphere, and flows by piping 102 to various electronic devices 106*a*, which may be connected in series, parallel or series-parallel with respect to each other, or to other electronic devices 106*b* via piping 102' of one or more second low flow rate coolant loops 100'. At the electronic devices 106*a*, 106*b* heat generated thereby is removed by absorption by the coolant flowing therepast. The coolant flows through an air separator 200, 200' according to the present invention, which has a coolant reservoir piping 108 connection to an elevated coolant reservoir 110 having a removable cap 112 whereat filling is performed and air can escape conventionally at the cap. A pump 114 powered by an electric motor 118 (in combination, simply an electric pump 116) is connected by the coolant piping, the inlet of the pump being connected to an outlet of the air separator 200, and the outlet of the pump being connected to the heat exchanger.

The coolant flows through the piping at a "slow" rate, as for example in the range of about five to twenty liters per minute (5 lpm to 20 lpm). Typically, the coolant piping 102, 102' has preferably about a 19 mm inside diameter, and may be in the form of tubing or flexible hose; and wherein the fittings used to interconnect the coolant piping has a preferably 17 mm minimum inside diameter. As shown at FIG. 4, there may be two electric pumps 116*a*, 116*b* connected in series. It is preferred for the piping to be straight-line between the air separator and the electric pump, and also straight-line between the electric pumps when dual electric pumps are used.

As shown at FIG. 3A, a first embodiment of the air separator 200 according to the present invention includes a closed canister 202 having a bottom wall 204, a top wall 206 at a gravitationally higher location with respect to the bottom wall, and sidewall 208 therebetween which is sealingly connected to the top and bottom walls. Preferably, the sidewall 208 is configured as a cylinder. A coolant inlet 210 is provided at the sidewall 208, a pump outlet 212 is located at the bottom wall 204 and a coolant reservoir outlet 214 is located at the top wall 206. The coolant inlet 210 is connected to the sidewall preferably generally adjacent the top wall 206 and is connected to coolant piping 102 (see FIG. 2) at the return leg thereof, wherein the coolant is returning from one or more heat generating electrical components. The coolant reservoir outlet 214 is connected (see FIG. 2) to the coolant reservoir piping 108 which connects to the coolant reservoir 110, wherein the coolant reservoir is gravitationally elevated with respect to the canister 202. The pump outlet 212 is connected to return coolant piping that is, in turn, connected (see FIG. 2) to the inlet of the electric pump 116 of the low flow rate coolant system.

In operation, coolant C flows (see arrows) into the canister 202 from the coolant inlet 210, wherein the cross-sectional area per unit length of the canister is much larger in relation to the average cross-sectional area per unit length of the coolant piping, as for example at least an order of magnitude larger cross-section, so that coolant has an extended dwell time in the canister before passing out through the pump outlet 212. This dwell time is sufficient to allow air bubbles A to migrate upwardly (see arrows) to the top wall 206, whereupon the air bubbles exit the canister through the coolant reservoir piping 108. At the coolant reservoir 110 the air is removed from the low flow rate system 100 conventionally through the fill cap 112 thereof.

By way of exemplification, a dwell time of the coolant in the canister 202 is preferably about 1.2 seconds, where the coolant, for example, is a 50/50 mix of water and anti-freeze. For a cylindrical sidewall 208, the height h may be set approximately equal to the diameter d, in which case, the interior volume, V, of the canister is defined by $V=\pi(d/2)^2h$, wherein for a 10 liter per minute flow rate, and if V=200 milliliters, then the dwell time is about 1.2 seconds for each milliliter of coolant, wherein the coolant flow rate has decreased by about an order of magnitude as between the piping and the canister.

FIG. 3B depicts a second embodiment of the air separator 200' according to the present invention, wherein like parts to the first embodiment of the air separator 200 of FIG. 3A have like numeral designations with a prime. Now the canister 202' has a diameter d' about twice as large as the height h'. An optional second coolant inlet 210*a* is located at the sidewall 208' preferably generally adjacent the top wall, and is connected, via coolant piping 102' (see FIG. 2), to a parallel, second low flow rate coolant loop 100' (see FIG. 2) which is sharing the air separator 200'.

By way of exemplification, a dwell time of the coolant in the canister 202' is preferably about 1.2 seconds, where the coolant, for example, is a 50/50 mix of water and anti-freeze. For a cylindrical sidewall 208', the height h' is approximately one-half the diameter d', in which case, the interior volume, V', of the canister is defined by $V'=\pi(d'/2)^2h'$, wherein for a 20 liter per minute flow rate, and if V=400 milliliters, then the dwell time is about 1.2 seconds for each milliliter of coolant, coolant, wherein the coolant flow rate has decreased by about an order of magnitude as between the piping and the canister.

Figure 5:
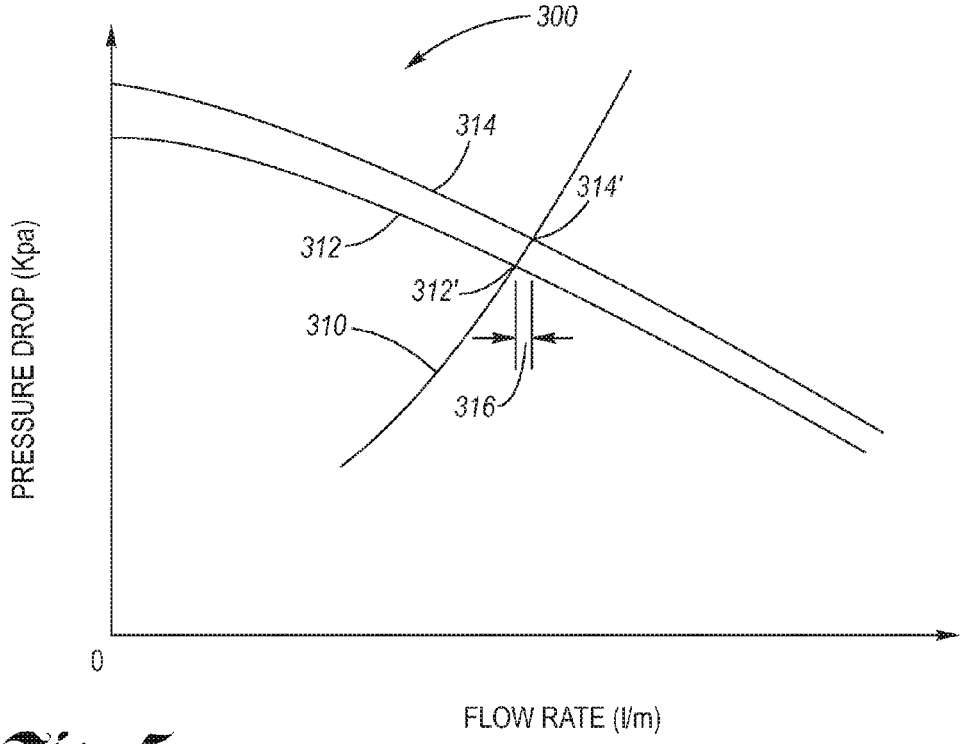
FIG. 5 is a pressure drop allocation graph for low flow rate coolant systems, comparing plots of pressure rise for the electric pump thereof with and without inclusion of the air separator according to the present invention.

A pressure drop allocation graph 300 for low flow rate coolant systems with and without the air separator according to the present invention is shown at FIG. 5.

Plot 310 depicts the pressure drop as a function of flow rate for all components of a low flow rate coolant system. Plot 312 depicts pressure rise as a function of flow rate for the electric pump, wherein there is no air separator present in the low flow rate coolant system. Plot 314 depicts pressure rise as a function of flow rate for the head pressure for the electric pump, wherein there is present an air separator according to the present invention in the low flow rate coolant system. It will be noted that a significant improvement is provided between the intersections 312' and 314', for example on the order of a ten percent (10%) improvement 316, by utilization of the air separator 200 in the low flow rate coolant system 100.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. An improved low flow rate coolant system comprising:
- a heat exchanger;
- at least one electric pump;
- at least one component to be cooled;
- a coolant reservoir;
- piping interconnecting the heat exchanger, the at least one electric pump, the coolant reservoir, and the at least one heat generating component; and a liquid coolant pumped by the at least one electric pump so as to flow, via the piping through the heat exchanger and remove heat from the at least one heat generating components, wherein said piping has an average piping cross-sectional area per unit length; and
- an air separator connected to said piping, said air separator comprising:
- a canister having a canister cross-sectional area per unit length, said canister comprising:
  - at least one coolant inlet connected to said at least one heat generating component via said piping;
  - a pump outlet connected to an inlet of said at least one electric pump via said piping; and
  - a coolant reservoir outlet connected to said coolant reservoir via said piping;
- wherein said coolant reservoir is located gravitationally higher than said canister, and wherein said canister cross-sectional area per unit length is larger by a predetermined amount than said average piping cross-sectional area per unit length such that coolant in said canister has a dwell time thereinside which allows air bubbles in said coolant to migrate toward said coolant reservoir outlet and thereupon continue to migrate to said coolant reservoir.

2. The improved low flow rate coolant system of claim 1, wherein said dwell time of the coolant in said canister is substantially between 1 and 2 seconds.

3. The improved low flow rate coolant system of claim 1, wherein flow of coolant inside said canister is substantially an order of magnitude slower than coolant flow through said piping.

4. The improved low flow rate coolant system of claim 3, wherein said dwell time of said coolant in said canister is substantially between 1 and 2 seconds.

5. The improved low flow rate coolant system of claim 1, wherein said low flow rate coolant system further comprises at least one additional low flow rate coolant loop, wherein said air separator further comprises at least one additional coolant inlet which connects to each respective additional low flow rate coolant loop via piping of said second low flow rate coolant system.

6. The improved low flow rate coolant system of claim 5, wherein said dwell time of said coolant in said canister is substantially between 1 and 2 seconds.

7. The improved low flow rate coolant system of claim 5, wherein flow of coolant inside said canister is substantially an order of magnitude slower than coolant flow through said piping.

8. The improved low flow rate coolant system of claim 7, wherein said dwell time of said coolant in said canister is substantially between 1 and 2 seconds.

9. In a low flow rate coolant system comprising a heat exchanger; at least one electric pump; at least one component to be cooled; a coolant reservoir; piping interconnecting the heat exchanger, the at least one electric pump, the coolant reservoir, and the at least one heat generating component; and a liquid coolant pumped by the at least one electric pump so as to flow, via the piping through the heat exchanger and remove heat from the at least one heat generating components, wherein the piping has an average piping cross-sectional area per unit length; the improvement thereto comprising:
- an air separator connected to said piping, said air separator comprising:
- a canister having a canister cross-sectional area per unit length, said canister comprising:
  - a top wall;
  - a bottom wall disposed gravitationally lower than said top wall;
  - a sidewall sealingly connected to each of said top and bottom walls;
  - at least one coolant inlet connected to said sidewall substantially adjacent said top wall and connected to said at least one heat generating component via said piping;
  - a pump outlet connected to said bottom wall and connected to an inlet of said at least one electric pump via said piping; and
  - a coolant reservoir outlet connected to said top wall and connected to said coolant reservoir via said piping;
- wherein the coolant reservoir is located gravitationally higher than said canister, wherein said canister cross-sectional area per unit length is larger by a predetermined amount than said average piping cross-sectional area per unit length such that coolant in said canister has a dwell time thereinside which allows air bubbles in said coolant to migrate toward said coolant reservoir outlet and thereupon continue to migrate to said coolant reservoir.

10. The improved low flow rate coolant system of claim 9, wherein said dwell time of the coolant in said canister is substantially between 1 and 2 seconds.

11. The improved low flow rate coolant system of claim 9, wherein flow of coolant inside said canister is substantially an order of magnitude slower than coolant flow through said piping.

12. The improved low flow rate coolant system of claim 11, wherein said dwell time of said coolant in said canister is substantially between 1 and 2 seconds.

13. The improved low flow rate coolant system of claim 9, wherein said low flow rate coolant system further comprises at least one additional low flow rate coolant loop, wherein said air separator further comprises at least one additional coolant inlet connected to said sidewall which connects to each respective additional low flow rate coolant loop via piping of said second low flow rate coolant system.

14. The improved low flow rate coolant system of claim 13, wherein said dwell time of said coolant in said canister is substantially between 1 and 2 seconds.

15. The improved low flow rate coolant system of claim 13, wherein flow of coolant inside said canister is substantially an order of magnitude slower than coolant flow through said piping.

16. The improved low flow rate coolant system of claim 15, wherein said dwell time of said coolant in said canister is substantially between 1 and 2 seconds.

* * * * *